US010011795B1

(12) United States Patent
Nuckols et al.

(10) Patent No.: US 10,011,795 B1
(45) Date of Patent: Jul. 3, 2018

(54) FUEL ADDITIVE MIXTURES AND FUELS CONTAINING THEM

(71) Applicant: AFTON CHEMICAL CORPORATION, Richmond, VA (US)

(72) Inventors: Michel Nuckols, Midlothian, VA (US); Charles Shanahan, Richmond, VA (US); Scott A Culley, Midlothian, VA (US); Keihann Yavari, Margny-les-Compiegne (FR); Lieven Van Hecke, Kortrijk (BE)

(73) Assignee: AFTON CHEMICAL CORPORATION, Richmond, VA (US)

( * ) Notice: Subject to any disclaimer, the term of this patent is extended or adjusted under 35 U.S.C. 154(b) by 0 days.

(21) Appl. No.: 15/855,011

(22) Filed: Dec. 27, 2017

(51) Int. Cl.
*C10L 1/224* (2006.01)
*C10L 1/232* (2006.01)

(52) U.S. Cl.
CPC ..... *C10L 1/224* (2013.01); *C10L 1/232* (2013.01); *C10L 2200/0423* (2013.01); *C10L 2270/023* (2013.01); *C10L 2300/40* (2013.01)

(58) Field of Classification Search
CPC ..... C10L 1/224; C10L 2200/0423; C10L 2300/40; C10L 2270/023
USPC ..... 44/399, 418, 419
See application file for complete search history.

(56) References Cited

U.S. PATENT DOCUMENTS

| | | | | |
|---|---|---|---|---|
| 2,089,212 | A | 8/1937 | Kritchevsky | |
| 2,844,609 | A | 7/1958 | Tesoro | |
| 3,503,891 | A | 3/1970 | Shimbor | |
| 4,428,754 | A | 1/1984 | Smith | |
| 4,729,769 | A | 3/1988 | Schlicht et al. | |
| 5,773,393 | A | 6/1998 | Adams | |
| 6,524,353 | B2 | 2/2003 | de Rosa et al. | |
| 7,244,857 | B2 | 7/2007 | Fox et al. | |
| 7,311,739 | B2 | 12/2007 | Bongart et al. | |
| 8,425,627 | B2 | 4/2013 | Dietz et al. | |
| 8,444,720 | B2 * | 5/2013 | Colucci | C07C 231/02 44/418 |
| 8,901,328 | B2 | 12/2014 | Suen et al. | |
| 9,017,430 | B2 | 4/2015 | Colucci et al. | |
| 9,340,742 | B1 * | 5/2016 | Fang | C10L 10/04 |
| 9,353,326 | B1 * | 5/2016 | Fang | C10L 1/143 |
| 9,382,495 | B1 * | 7/2016 | Fang | C10L 1/2387 |
| 9,447,351 | B2 * | 9/2016 | Jung | C10L 1/22 |
| 9,873,849 | B2 * | 1/2018 | Culley | C10L 10/08 |
| 2010/0132253 | A1 | 6/2010 | Kaufman et al. | |
| 2010/0146845 | A1 * | 6/2010 | Burgazli | C10L 1/143 44/344 |
| 2011/0162263 | A1 * | 7/2011 | Vilardo | C10L 10/14 44/389 |
| 2016/0060560 | A1 | 3/2016 | Suen et al. | |
| 2016/0130514 | A1 * | 5/2016 | Hansch | C10L 1/1883 508/547 |

FOREIGN PATENT DOCUMENTS

| | | | |
|---|---|---|---|
| WO | 200110982 | A1 | 2/2001 |
| WO | 200162877 | A1 | 8/2001 |

* cited by examiner

*Primary Examiner* — Ellen M McAvoy
(74) *Attorney, Agent, or Firm* — Luedeka Neely Group, P.C.

(57) ABSTRACT

A fuel additive concentrate for gasoline, a gasoline fuel containing an additive mixture, a method for reducing wear in an engine and in a fuel delivery system of a gasoline engine, and a method for improving injector performance. The additive concentrate includes an aromatic solvent and a mixture that contains (i) N,N-bis(2-hydroxyethyl)alkylamide, (ii) 2-((2-(bis(2-hydroxyethyl)amino)ethyl)amino)ethyl alkanoate and N-(2-(bis(2-hydroxyethyl)amino)ethyl)-N-(2-hydroxyethyl)alkylamide, and (iii) fatty acid ester(s) and amide(s) derived from a self-condensation product of diethanolamine (DEA) containing at least 3 amino groups. A weight ratio of (i) to (ii) to (iii) in the concentrate ranges from about 8:2:0 to about 2:5:3. The fuel additive mixture is substantially devoid of glycerin and remains fluid at a temperature down to about −20° C.

25 Claims, No Drawings

FUEL ADDITIVE MIXTURES AND FUELS CONTAINING THEM

RELATED APPLICATION

This application is related to a co-pending application filed this same day as a result of a joint development between Afton Chemical Corporation of Richmond, Va., Oleon NV of Belgium and Oleon SAS of France.

TECHNICAL FIELD

The disclosure is directed to fuel additives for fuel compositions and to fuel compositions containing the additives. In particular, the disclosure relates to a gasoline fuel additive mixture that has improved properties with respect to friction, wear reduction, and injector deposits in fuel compositions and provides enhanced low temperature stability to a fuel additive concentrate containing the additive mixture. More particularly, the additive mixture is a friction modifier and fuel injector cleaner derived from fatty acids and diethanolamine or self-condensation products of diethanolamine that is made by a process that improves low temperature compatibility of fuel additive concentrates containing the additive mixture.

BACKGROUND AND SUMMARY

Fuel compositions for vehicles are continually being improved to enhance various properties of the fuels in order to accommodate their use in newer, more advanced engines including direct injection gasoline engines. Accordingly, fuel compositions typically include additives that are directed to certain properties that require improvement. For example, friction modifiers are added to fuel to reduce friction and wear in the fuel delivery systems and piston rings of an engine. In addition, special components may be added to fuel to reduce injector nozzle fouling, clean dirty injectors and improve the performance of direct injection combustion engines. When such additives are added to the fuel, a portion of the additives is transferred into the thin film of lubricant in the engine piston ring zone where it may also reduce friction and wear and thus improve fuel economy. Such fuel additives are passed into the crankcase during engine operation, so that a fuel additive that is also beneficial to the engine lubricant is desirable. However, fuel additive concentrates containing friction modifiers made from diethanolamine and certain fatty acids or their corresponding esters, may be unstable when stored at low temperatures and the performance of such friction modifiers is often less than desirable. In addition, certain fatty acid based amine and alkanolamide friction modifiers are waxes or partial solids that are difficult to handle at low ambient temperatures.

Friction modifiers that are made from acids and esters that are derived from saturated or mono-unsaturated fatty acids such as lauric, myristic, palmitic, and stearic acid are particularly difficult to formulate into additive concentrates that remain fluid and homogeneous at low temperatures. The instability can be exacerbated by the typical detergent additives that are used in fuel additive concentrates, such as polyisobutene Mannich additives. Since additive concentrates are the preferred form to blend fuel additive components into the fuel, it is essential that fuel additive concentrates be homogeneous and remain fluid at low temperatures, preferably down to about −20° C. or lower.

When the friction modifier additive concentration is fairly high in the concentrate, compatibilizers and/or large amounts of solvent may be added to the additive composition to improve its solubility at low temperatures. Compatibilizers that have been used include low molecular weight alcohols, esters, anhydrides, succinimides, glycol ethers, and alkylated phenols, and mixtures thereof. Alternatively, some additive producers have incorporated low molecular weight esters into the reaction mixture of fatty acids with the diethanolamine to enhance the low temperature stability of the reaction product. Unfortunately, the costs that solvents, compatibilizers, and low molecular weight esters add to additive concentrates may make their use uneconomical.

Partial esters of fatty acids and polyhydroxy alcohols such as glycerol monooleate (GMO) and fatty amine ethoxylates such as diethoxylated laurylamine are also known fuel additives that reduce friction and wear and may improve fuel economy. GMO and some fatty amine ethoxylates have poor compatibility in fuel additive concentrates when the concentrates are stored at low temperatures. It is particularly difficult to prepare fuel additive concentrates containing both GMO and fatty amine diethoxylates that are stable at low temperature. While GMO and fatty amine ethoxylate friction modifiers may improve fuel economy when added to a fuel, GMO and certain fatty amine ethoxylates may be unstable in additive concentrates or may require large amounts of solvent and compatibilizers to keep the additive concentrate stable and fluid at low temperatures. Accordingly, GMO, fatty amine ethoxylates, and fatty alkanolamide friction modifiers cannot be beneficially added to a fuel composition to improve the fuel economy and wear protection of the fuel delivery system unless they can be formulated into a stable fuel additive concentrate.

Many other friction modifiers have been tried, however there remains a need for a friction modifier that can be readily formulated into fuel additive concentrates that are stable at low temperatures, i.e., temperatures as low as about −20° C. There is also a need for a friction modifier that improves the low temperature compatibility of other fuel additive components in fuel additive concentrates. Moreover, there is a need for a friction modifier that improves the friction and wear properties of other fuel additives. Additionally, there is a need for a friction modifier that improves fuel economy, and that provides wear protection to fuel delivery systems, among others characteristics.

Fuel compositions for direct fuel injected engines often produce undesirable deposits in the injectors, engine combustion chambers, fuel supply systems, fuel filters, and intake valves. Accordingly, improved compositions that can prevent deposit build up and maintain cleanliness "as new" for the life of the vehicle are desired. A composition that can clean dirty fuel injectors, restore performance to the previous "as new" condition and improve the power performance of the engines is desirable and valuable for reducing air borne exhaust emissions. Although there are additives known to reduce injector nozzle fouling and reduce intake valve deposits, their clean-up performance and keep clean effect may be insufficient. Furthermore, their stability and interaction with other fuel additives may be unsatisfactory. Accordingly, there continues to be a need for a fuel additive that is cost effective, readily incorporated into additive concentrates, and improves multiple characteristics of a fuel.

In accordance with the disclosure, exemplary embodiments provide a fuel additive concentrate for gasoline, a gasoline fuel containing an additive mixture, a method for reducing wear in an engine and in a fuel delivery system of a gasoline engine, and a method for improving injector performance. The additive concentrate includes an aromatic solvent and a mixture that contains (i) N,N-bis(2-hydroxy-ethyl)alkylamide, (ii) 2-((2-(bis(2-hydroxyethyl)amino) ethyl)-amino)ethyl alkanoate and N-(2-(bis(2-hydroxyethyl) amino)ethyl)-N-(2-hydroxyethyl)alkyl-amide, and (iii) fatty acid ester(s) and amide(s) derived from a self-condensation product of diethanolamine (DEA) containing at least 3 amino groups. A weight ratio of (i) to (ii) to (iii) in the concentrate ranges from about 8:2:0 to about 2:5:3. The fuel additive mixture is substantially devoid of glycerin and remains fluid at a temperature down to about −20° C.

In one embodiment there is provided a gasoline fuel composition for reducing fuel system component wear and engine friction, and improving injector cleanliness. The composition includes A) gasoline and B) a fuel additive mixture that contains a) N,N-bis(2-hydroxy-ethyl)alkyl amide, b) 2-((2-(bis(2-hydroxyethyl)amino)ethyl)amino) ethyl alkanoate and N-(2-(bis(2-hydroxyethyl)-amino) ethyl)-N-(2-hydroxyethyl)alkylamide, and c) fatty acid ester(s) and amide(s) derived from a self-condensation product of diethanolamine (DEA) containing at least 3 amino groups, wherein the alkyl groups of the amide(s) and ester(s) contain from 8 to 18 carbon atoms. A weight ratio of (a) to (b) to (c) in the fuel additive mixture ranges from about 8:2:0 to about 2:5:3. The fuel additive mixture is substantially devoid of glycerin and remains fluid at a temperature down to about −20 C°.

In accordance with another embodiment of the disclosure, there is provided a method for reducing wear and engine friction. The method includes providing gasoline containing a wear reducing additive mixture that consists essentially of: a) N,N-bis(2-hydroxy-ethyl)alkyl amide, b) 2-((2-(bis(2-hydroxyethyl)amino)ethyl)amino)ethyl alkanoate and N-(2-(bis(2-hydroxyethyl)amino)ethyl)-N-(2-hydroxyethyl)alkylamide, and c) fatty acid ester(s) and amide(s) derived from a self-condensation product of diethanolamine (DEA) containing at least 3 amino groups. The additive mixture is substantially devoid of glycerin and a weight ratio of (a) to (b) to (c) ranges from about 8:2:0 to about 2:5:3. The additive mixture is combined with gasoline to provide a fuel composition and the engine is operated on the fuel composition.

A further embodiment of the disclosure provides a method for improving the injector performance of a fuel injected gasoline engine. The method includes providing gasoline containing an injector cleaning additive mixture that consists essentially of: a) N,N-bis(2-hydroxy-ethyl)alkyl amide, b) 2-((2-(bis(2-hydroxyethyl)amino)ethyl)amino)ethyl alkanoate and N-(2-(bis(2-hydroxyethyl)amino)ethyl)-N-(2-hydroxyethyl)alkylamide, and c) fatty acid ester(s) and amide(s) derived from a self-condensation product of diethanolamine (DEA) containing at least 3 amino groups. The additive mixture is substantially devoid of glycerin and a weight ratio of (a) to (b) to (c) ranges from about 8:2:0 to about 2:5:3. The additive mixture is combined with gasoline to provide a fuel composition and the engine is operated on the fuel composition.

In some embodiments, the additive mixture contains less than 3 wt. % diesters and diamides that are derived from the reaction of a second fatty acid with the aforementioned alkanolamides and esters and amides and esters derived from self-condensation products of DEA.

In some embodiments, the additive mixture contains less than 3 wt. % N,N'-bis(2-hydroxyethyl)piperazine, such as less than 0.5 wt. % N,N'-bis(2-hydroxyethyl)piperazine based on a total weight of the additive mixture.

In some embodiments, the additive mixture contains from about 5 to about 30 wt. % of fatty acid ester(s) and amide(s) derived from a self-condensation product of DEA containing at least 3 amino groups based on a total weight of the additive mixture.

In other embodiments, the alkyl groups of the amide(s) and ester(s) contain from 8 to 18 carbon atoms. In some embodiments, 45 to 55 wt. % of the alkyl groups in the amide(s) and ester(s) are dodecyl groups.

In some embodiments, an additive concentrate for gasoline contains from about 10 to about 90 wt. % of the fuel additive mixture described above based on a total weight of the additive concentrate.

In other embodiments, the fuel additive concentrate also contains one or more detergents and one or more carrier fluids.

In some embodiments, fuel additive concentrate further includes a friction modifier selected from partial esters of fatty acid and polyhydroxy alcohols, N,N-bis(2-hydroxy-alkyl)-alkylamines, and mixtures thereof, wherein a weight ratio of friction modifier to fuel additive mixture in the concentrate ranges from about 10:1 to about 1:10

In some embodiments, a gasoline containing the fuel additive mixture described above has a high frequency reciprocating rig (HFRR) wear scar of no more than about 690 μm.

In some embodiments, a gasoline containing the fuel additive mixture described above has injector clean-up improvement of 98%.

In a further embodiment, the fuel composition contains from about 10 to about 1500 ppm by weight, such as from about 40 to about 750 ppm by weight, or from about 50 to about 500 ppm by weight, or from about 50 to about 300 ppm by weight of the fuel additive mixture.

As set forth above, the additive mixture as described herein surprisingly and quite unexpectedly is a stable fuel additive mixture that remains liquid at low temperature and also provides an improvement in friction and wear reduction of a fuel composition containing the additive mixture. It was also surprising and quite unexpected that the additive mixture as described herein was effective in cleaning dirty fuel injectors sufficient to provide improved engine performance. The additive mixture also provides suitable friction and wear reduction that is at least as good, if not better than the friction and wear reduction provided by conventional friction modifiers.

Additional embodiments and advantages of the disclosure will be set forth in part in the detailed description which follows, and/or can be learned by practice of the disclosure. It is to be understood that both the foregoing general description and the following detailed description are exemplary and explanatory only and are not restrictive of the disclosure, as claimed.

DETAILED DESCRIPTION OF EXEMPLARY EMBODIMENTS

The fuel additive mixture of the present disclosure may be used in a minor amount in a major amount of fuel and may be added to the fuel directly or added as a component of an additive concentrate to the fuel.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 wt. %, relative to the total weight of the composition. Moreover, as used herein, the term "minor amount" is understood to mean an amount less than 50 wt. % relative to the total weight of the composition.

A suitable fuel additive mixture may contain reaction products of a fatty acid, fatty acid ester, or mixtures thereof and dialkanolamine or self-condensation products of a dialkanolamine, wherein the alky group has from 2 to 4 carbon atoms. The fuel additive mixture is substantially devoid of glycerin. The N,N-bis(2-hydroxyethyl)alkylamides typically have short chain ($C_2$-$C_4$) hydroxyalkyl groups and a long chain ($C_8$-$C_{24}$) alkyl group. A suitable compound of this type is derived from coconut oil containing lauric acid as a major component and diethanolamine (DEA). One component of the products used as an effective friction reducing and injector cleaning agent in fuel may have the following structure (I):

I

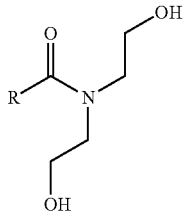

wherein R is a hydrocarbyl group having from 8 to 24 carbon atoms, such as from about 10 to 20 carbon atoms or from 12 to 18 carbon atoms wherein R is linear or branched and may be saturated or unsaturated. A suitable N,N-bis(2-hydroxyalkyl)alkylamide is N,N-bis(2-hydroxyethyl)dodecylamide which is usually derived from coconut fatty acid so that the $R^1$ substituent generally ranges from $C_8$ to $C_{18}$, with $C_{12}$ and $C_{14}$ groups predominating and being mostly straight chain.

The reaction product suitably contains as a major component or a minor component a mixture of N,N-bis(2-hydroxyethyl)alkylamides. A small amount of esters may be present after the reaction of a fatty acid, fatty acid ester, or mixtures thereof and diethanolamine.

The reaction product also contains as one component a mixture of amides and esters derived from the reaction of fatty acid with a self-condensation product of diethanolamine. One of the components that is present in an amount of up to about 45 wt. % of such products is N-(2-(bis(2-hydroxyethyl)amino)ethyl)-N-(2-hydroxyethyl) alkylamide which has the following structure (II):

II

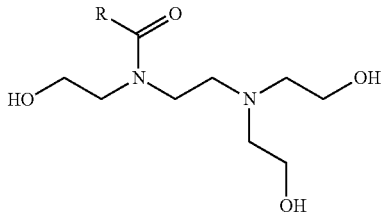

wherein R has the same meaning as described above. The formation of product II may arise from the condensation of two diethanolamines. The amine group of a one diethanolamine can combine with the hydroxyl group of a second diethanolamine to eliminate water and create a new carbon nitrogen bond resulting in the formation of N,N,N'-tris(2-hydroxyethyl)ethylenediamine also called DEA dimer. Tris (2-hydroxyethyl)ethylenediamine subsequently condenses with a fatty acid to form product II. Alternatively, reaction product II may arise from the condensation of DEA with one of the hydroxyl groups of product I and the elimination of water. Also included within products used as effective friction and wear reducing and injector cleaning agents are amides that arise from the self-condensation of three or more diethanolamines also called DEA trimers. Esters may also be formed by the reaction of a fatty acid, fatty acid ester, or mixtures thereof and the self-condensation products of DEA trimers. Although the products used as effective friction and wear reducing and injector cleaning agents containing two or more nitrogens may result from two slightly different pathways, for the purpose of clarity, these products will be referred to as arising from DEA dimers, trimers, and oligomers.

Accordingly, the fuel additive mixture includes at least one fatty acid amide of DEA and at least one fatty acid ester and/or amide of a self-condensation product of DEA wherein DEA is a compound of formula (III)

(III)

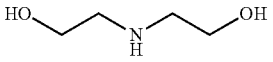

and wherein the self-condensation products of DEA contain two or more amino groups and may be selected from the DEA dimer, N,N,N'-tris(2-hydroxyethyl)ethylenediamine of formula (IV)

(IV)

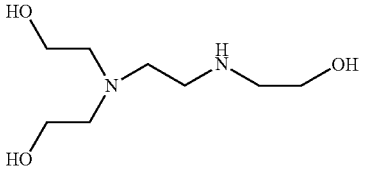

and the DEA trimers, tetrakis(2-hydroxyethyl)diethylenetriamines of formulas (V) and (VI)

(V)

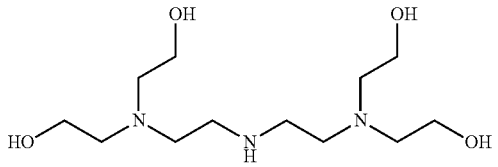

or (VI)

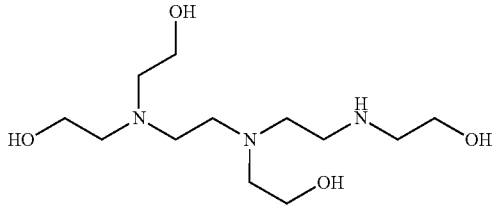

and other DEA self-condensation products also called DEA oligomers of the formula $$N_x(CH_2CH_2)_{x-1}(CH_2CH_2OH)_{x+1} \quad \text{(VII)}$$

wherein x is an integer ranging from 1 to 6.

The fatty acid amide of DEA may be derived from a fatty acid or mixture of fatty acids containing from 8 to 18 carbon atoms. In one embodiment, the fatty acid amide of DEA is N,N-bis(2-hydroxyethyl)dodecanamide of formula (VIII)

(VIII)

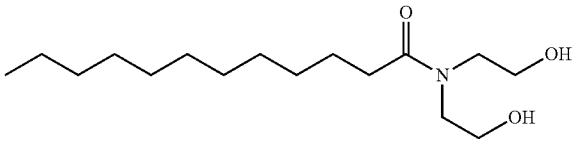

The fatty acid amide(s) and ester(s) derived from the self-condensation products of DEA may also have alkyl groups derived from a fatty acid or mixture of fatty acids containing from 8 to 18 carbon atoms. In one embodiment, the fatty acid ester derived from the self-condensation product of DEA is 2-((2-(bis(2-hydroxyethyl)amino)ethyl)amino)ethyl dodecanoate of formula (IX):

(IX)

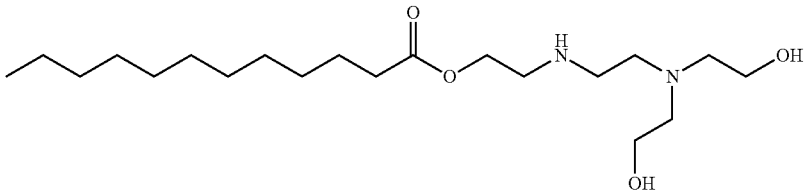

and the fatty acid amide derived from the self-condensation product of DEA is N-(2-(bis(2-hydroxyethyl)amino)ethyl)-N-(2-hydroxyethyl)dodecanamide of formula (X):

(X)

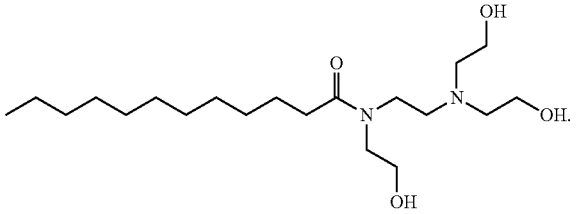

The fatty acid ester and/or amide of the self-condensation product of DEA may also include amide(s) and esters(s) of the self-condensation products of formulas (V), (VI) and (VII).

In some embodiments, the quantity of fatty acid amide(s) derived from DEA of formula (III) may range from about 20 to about 80 wt. % based on a total weight of the additive mixture, such as from about 30 to about 75 wt. %, and suitably from about 40 to about 60 wt. % based on a total weight of the additive mixture.

In one embodiment, the additive mixture includes from about 20 to about 30 wt. % of N,N-bis(2-hydroxyethyl) dodecanamide, with respect to the total weight of the additive mixture.

In other embodiments, the total quantity of fatty acid ester(s) and/or amide(s) derived from DEA of formulas (IV), (V), (VI), and (VII) in the additive mixture may range from about 20 to about 80 wt. % of the total weight of the additive mixture, preferably from about 30 to about 60 wt. % with respect to the total weight of the additive mixture.

In some embodiments, the quantity of fatty acid ester(s) and fatty acid amide(s) of tris(2-hydroxyethyl)ethylenediamine of formula (IV) may range from about 15 to about 60 wt. % based on a total weight of the additive mixture such as from about 20 to about 55 wt. % of the total weight of the additive mixture, and suitably from about 30 to about 45 wt. % of the additive mixture.

In some embodiments, the quantity of fatty acid ester(s) and fatty acid amide(s) derived from the self-condensation products of DEA other than from tris(2-hydroxyethyl)-ethylenediamine of formula (IV) may range from about 5 wt. % to about 30 wt. % of the total weight of the additive mixture, such as from about 10 to about 25 wt. % of the total weight of the additive mixture and suitably from about 15 to about 20 wt. % of the additive mixture.

In other embodiments, the additive mixture contains less than 3 wt. % of (N,N'-bis(2-hydroxyethyl)piperazine (BHEP), such as less than 2 wt. % BHEP, or less than 0.5 wt. % BHEP and suitably less than 0.2 wt. % BHEP based on a total weight of the additive mixture.

In some embodiments, the additive mixture includes 40 to about 60 wt. % of N,N-bis(2-hydroxyethyl)alkylamide based on a total weight of the additive mixture, from about 30 to about 45 wt. % of 2-((2-(bis(2-hydroxyethyl)amino)ethyl)amino)ethyl alkanoate and N-(2-(bis(2-hydroxyethyl)amino)ethyl)-N-(2-hydroxyethyl)alkylamide based on a total weight of the additive mixture, and from about 10 to about 25 wt. % of fatty acid ester(s) and amide(s) derived from the self-condensation products of diethanolamine (DEA) containing at least 3 amino groups based on a total weight of the mixture.

In one embodiment, the additive mixture includes from about 25 to about 40 wt. % N,N-bis(2-hydroxyethyl)dodecanamide based on a total weight of the additive mixture, from about 15 to about 25 wt. % of 2-((2-(bis(2-hydroxyethyl)amino)ethyl)amino)ethyl dodecanoate and N-(2-(bis(2-hydroxyethyl)amino)ethyl)-N-(2-hydroxyethyl)dodecanamide based on a total weight of the additive mixture and from about 2.5 to about 8 wt. % of $C_{12}$ fatty acid ester(s) and amide(s) derived from the self-condensation product of DEA other than from tris(2-hydroxyethyl)ethylenediamine of formula (III), based on a total weight of the additive mixture.

The additive mixture described herein may be made by reacting fatty acid(s) with DEA, wherein the reaction is conducted in the presence of a molar excess of DEA relative to the fatty acid(s) and at a pressure of from about 20 to about 500 mBar, for example from about 100 to about 300 mBar at a temperature ranging from about 120° to about 160° C., suitably from about 130° to about 150° C. The molar ratio of DEA to fatty acid(s) may range from about 1.2:1 to about 5:1, suitably from about 1.5:1 to about 4:1 equivalents of DEA per equivalents of acid. In order to react the fatty acid(s) and DEA all of reactants are directly placed in a reactor and reacted in one step. No alkaline catalyst is needed to perform the reaction, however an acid catalyst may be used if desired.

The reaction may be conducted over a period of time ranging from about 6 hours to about 30 hours, such as from about 10 hours to about 26 hours. When the reaction is conducted at a pressure above about 50 mBar, the pressure is then reduced to about 10 to about 50 mBar once an acid value of about 50 mg KOH/g is obtained. The reduction in pressure enables water to be removed from the reaction mixture and displaces the reaction equilibrium towards the formation of ester(s)/amide(s).

In some embodiments, the fatty acid(s) is lauric acid and/or myristic acid. Lauric acid is a 12-carbon chain fatty acid and myristic acid is a 14-carbon chain fatty acid. Particularly useful fatty acid(s) are fatty acids resulting from coconut oil. As an example, fatty acids may result from hydrolyzation of coconut oil. Once hydrolyzed, this oil is particularly rich in lauric acid.

Once the reaction is complete, the excess DEA is removed from the reaction product. The reaction is considered complete when the acid value of the reaction mixture is below 5 mg KOH/g, for example, below 3 mg KOH/g, and suitably below 2 mg KOH/g. Any excess fatty acid(s) remaining in the reaction product and the DEA may be removed by distilling the reaction product. The reaction product, as made, may contain less than about 0.5 wt. % BHEP, suitably less than about 0.2 wt. % BHEP based on a total weight of the reaction product, and is substantially devoid of glycerin.

The concentration of the foregoing additive mixture in the gasoline is usually at least 5 ppm by weight, such as from about 5 to about 1500 ppm by weight, typically from about 40 to about 750 ppm by weight, and desirably from about 50 to about 500 ppm by weight based on a total weight of a gasoline composition containing the additive mixture.

One or more additional optional compounds may be present in the fuel additive compositions of the disclosed embodiments. For example, the fuel additives may contain conventional quantities of octane improvers, corrosion inhibitors, cold flow improvers (CFPP additive), pour point depressants, solvents, demulsifiers, lubricity additives, additional friction modifiers, amine stabilizers, combustion improvers, dispersants, detergents, antioxidants, heat stabilizers, conductivity improvers, metal deactivators, carrier fluid, marker dyes, organic nitrate ignition accelerators, cyclomatic manganese tricarbonyl compounds, and the like. In some aspects, the additive compositions described herein may contain about 50 weight percent or more, or in other aspects, about 75 weight percent or more, based on the total weight of the additive composition, of one or more of the above additives. Similarly, the fuels may contain suitable amounts of conventional fuel blending components such as methanol, ethanol, dialkyl ethers, 2-ethylhexanol, and the like.

In one embodiment, a fuel additive concentrate may contain the above described reaction products of a fatty acid, fatty acid ester, or mixtures thereof and diethanolamine or self-condensation products of diethanolamine in combination with a carrier fluid and other ingredients selected from one or more detergents selected from Mannich base detergents, polyalkylamines, polyalkylpolyamines, polyalkenyl succinimides, and quaternary ammonium salt detergents.

Suitable carrier fluids may be selected from any suitable carrier fluid that is compatible with the gasoline and is capable of dissolving or dispersing the components of the additive concentrate. Typically, the carrier fluid is a hydrocarbyl polyether or a hydrocarbon fluid, for example a petroleum or synthetic lubricating oil basestock including mineral oil, synthetic oils such as polyesters or polyethers or other polyols, or hydrocracked or hydroisomerised basestock. Alternatively, the carrier fluid may be a distillate boiling in the gasoline range. The amount of carrier fluid contained in the additive concentrate may range from 10 to 80 wt. %, or from 20 to 75 wt. %, or from 30 to 60 wt. % based on a total weight of the additive concentrate. Such additive concentrates containing the inventive components, detergent and carrier fluid were found to remain as clear fluids even at temperatures as low as −20° C.

The additive mixture of the present disclosure, including the reaction products of a fatty acid, fatty acid ester, or mixtures thereof and diethanolamine or self-condensation products of diethanolamine described above, and optional additives used in formulating the fuels of this invention may be blended into the base fuel individually or in various sub-combinations. In some embodiments, the additive mixture of the present application may be blended into the fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors. Accordingly, a fuel additive concentrate may contain from about 5 to about 50 wt. % of the fuel additive mixture derived from DEA and fatty acid(s) described above.

The fuels of the present application may be applicable to the operation of gasoline and diesel engines. The engines include both stationary engines (e.g., engines used in electrical power generation installations, in pumping stations, etc.) and ambulatory engines (e.g., engines used as prime movers in automobiles, trucks, road-grading equipment, military vehicles, etc.).

EXAMPLES

The following examples are illustrative of exemplary embodiments of the disclosure. In these examples as well as elsewhere in this application, all parts and percentages are by weight unless otherwise indicated. It is intended that these examples are being presented for the purpose of illustration only and are not intended to limit the scope of the invention disclosed herein.

Comparative Example 1

Comparative example 1 was prepared by heating 2.7 moles of $C_8$-$C_{18}$ fatty acid mixture from coconut oil containing from 45 to 56 wt. % of lauric acid, and from 15 to 23 wt. % of myristic acid, having an acid value of 264 to 277 mg KOH/g and a calculated iodine number of 6-15 and 1.0 mole of diethanolamine (DEA) at 150° C. with stirring, in a small amount of xylene for approximately three hours and removing the water that is formed azeotropically. The reaction product contained as a major component $C_8$-$C_{18}$ fatty acid diesters and triesters of N,N-bis(2-hydroxyethyl)alkylamides. In a second step, 1.6 moles of diethanolamine were added to the N,N-bis(2-hydroxyethyl)alkylamide ester mixture that was obtained in the first step and the mixture was heated to 150° C. with stirring for approximately two hours after which the solvent was distilled off to give a brown viscous oil. The progress of the reaction was monitored by removing aliquots and measuring the amide:ester ratio by infrared spectroscopy. Transmission Infrared Spectroscopy of the material showed a 2.9:1 ratio of amide absorbance at 1622 cm-1 to ester absorbance at 1740 cm-1. Comparative example 1 is further described in table 1.

Comparative Example 2

Comparative example 2 was prepared in a single step by mixing 1.0 moles of DEA with 1.1 moles of the same coconut fatty acid as was used in comparative example 1. A small amount of xylene was added and the mixture was heated to 150° C. with stirring and the water was removed azeotropically. Using a slight excess of fatty acid ensures that there is a minimal amount of unreacted diethanolamine at the end of the reaction. The progress of the reaction was monitored by removing aliquots and measuring the amide: ester ratio by infrared spectroscopy. Transmission Infrared Spectroscopy of the material showed a 2.3:1 ratio of amide absorbance at 1622 cm-1 to ester absorbance at 1740 cm-1. Comparative example 2 is further described in table 1.

Comparative Example 3

Comparative Example 3 was prepared in the same manner as Comparative Example 2, but used isostearic acid having an acid value of 180 to 205 mg KOH/g and a calculated iodine number of 4 instead of coconut fatty acid and employed a molar ratio of isostearic acid to diethanolamine of 1.4:1. Spectroscopy of the material showed a 1.1:1 ratio of amide absorbance at 1622 cm-1 to ester absorbance at 1740 cm-1. Comparative example 3 is further described in table 1.

Comparative Example 4

Comparative Example 4 was prepared by the method of U.S. Pat. No. 6,524,353 B2 which discloses a fuel additive composition consisting of the reaction product of (a) diethanolamine; (b) coconut oil; and (c) methyl caprylate; wherein the molar ratio of a:b:c: is 1.0:0.7:0.3.

Inventive Additive Mixture

Four moles of $C_8$-$C_{18}$ fatty acid mixture from coconut oil containing from 45 to 56 wt. % of lauric acid, and from 15 to 23 wt. % of myristic acid, having an acid value of 264 to 277 mg KOH/g and a calculated iodine number of 6-15 was reacted with 8 moles of diethanolamine (DEA). The reaction mixture was heated to 150° C. with stirring and the pressure was reduced to 200 mBar for about 10 hours. Once the acid value reached 50 mg KOH/g, the pressure was reduced to 20 mBar until the acid value became smaller than 2 mg KOH/g. The reaction product mixture was then distilled to remove excess of DEA and optionally fatty acid(s). Spectroscopy of the material showed a 8.9:1 ratio of amide absorbance at 1622 cm-1 to ester absorbance at 1740 cm-1. The Inventive Additive Mixture is further described in Table 1.

TABLE 1

Physical and Chemical Properties of Alkanolamide Fuel Additives

| Example | BHEP (wt. %) | Free DEA (wt. %) | Nitrogen (wt. %) | TAN (mg KOH/g) | TBN (mg KOH/g) | PP (° C.) |
|---|---|---|---|---|---|---|
| Inventive Additive | <0.20 | <0.4 | 6.29 | 0.5 | 99.6 | −9 |
| Comparative Ex. 1 | 0.32 | 1.24 | 4.37 | 3.1 | 20.5 | +3 |
| Comparative Ex. 2 | 0.51 | 0.18 | 4.57 | 1.4 | 51.4 | −2 |
| Comparative Ex. 3 | 0.06 | 0.3 | 2.81 | 1.7 | 14.6 | <−30 |

In the following examples in tables 2 and 3, a wear test was conducted on an E-10 gasoline fuel. All of the tests contained E10 gasoline and the amount of additive listed in the table. Gasoline Packages 1, 2 and 3 were three different conventional gasoline additive packages that contained Mannich detergents, carrier fluids, corrosion inhibitors, demulsifiers, and the like, plus solvent and a minor amount of 2-ethylhexanol. The wear tests were conducted using a high frequency reciprocating rig (HFRR) using method ASTM D 6079 that was modified to allow testing the gasoline at a temperature of 25° C. The average of two tests were used to determine the mean wear scar diameter results that are reported in tables.

TABLE 2

HFRR of Fuel Additive Concentrates

| Example No. | Additive | Treat rate, ppm by wt. | HFRR Average MWSD (μm) |
|---|---|---|---|
| 1 | E10 gasoline - no additives | 0 | 785 |
| 2 | Gasoline Package 1 | 304 | 768 |
| 3 | Inventive Additive plus Package 1 | 457 | 685 |
| 4 | Comparative Example 1 plus Package 1 | 457 | 753 |

TABLE 2-continued

HFRR of Fuel Additive Concentrates

| Example No. | Additive | Treat rate, ppm by wt. | HFRR Average MWSD (μm) |
|---|---|---|---|
| 5 | Comparative Example 2 plus Package 1 | 457 | 707 |
| 6 | Comparative Example 3 plus Package 1 | 457 | 744 |
| 7 | Gasoline Package 2 | 285 | 758 |
| 8 | Inventive Additive plus Package 2 | 438 | 602 |
| 9 | Comparative Example 1 plus Package 2 | 438 | 692 |
| 10 | Comparative Example 2 plus Package 2 | 438 | 674 |
| 11 | Comparative Example 3 plus Package 2 | 438 | 688 |

Example Nos. 1, 2, and 7 in table 2 provide the HFRR data for the base fuel and the base fuel plus the two Gasoline Package concentrates respectively. The HFRR results for the base fuel plus concentrates with the inventive friction modifier (Example Nos. 3 and 8) were better than the comparative fuel additives (Example Nos. 4, 5, 6 and 9, 10, 11). The Inventive Additive gave the lowest wear scar in both of the additive concentrates. Examples Nos. 4, 5, and 6 that contained Package 1 and Comparative Examples 1, 2 and 3 respectively had HFRR wear scars above 700 microns while the Example No. 3 that contained the Inventive Additive had a wear scar of 685 microns. When Gasoline Package 2 was used, Example No. 8 containing the inventive additive had a wear scar of just over 600 microns while the Comparative Examples Nos. 9, 10, and 11 had wear scars of greater than of 670 microns. Accordingly, it was surprising and quite unexpected that the Inventive additive would provide lower HFRR wear scars than the examples containing the comparative friction modifiers. The lower wear scars of the additive concentrate containing Inventive Additive according to the disclosure could not be predicted from the data of Example Nos. 4-6 and 9-11.

TABLE 3

HFRR of Inventive Additive with other FMs

| Example No. | Gasoline Package 3 | Inventive Add. | Comp. Ex. 4 | GMO | Dieth-oxylated laurylamine | Average MWSD (μm) |
|---|---|---|---|---|---|---|
| 1 | 0 | 0 | 0 | 0 | 0 | 741 |
| 2 | 304 | 0 | 0 | 0 | 0 | 704 |
| 3 | 304 | 153 | 0 | 0 | 0 | 575 |
| 4 | 304 | 0 | 153 | 0 | 0 | 580 |
| 5 | 304 | 0 | 0 | 153 | 0 | 600 |
| 6 | 304 | 76 | 0 | 76 | 0 | 566 |
| 7 | 304 | 153 | 0 | 153 | 0 | 520 |
| 8 | 304 | 76 | 0 | 0 | 76 | 635 |
| 9 | 304 | 153 | 0 | 0 | 153 | 639 |
| 10 | 304 | 0 | 0 | 0 | 153 | 668 |
| 11 | 304 | 38 | 0 | 76 | 76 | 598 |
| 12 | 304 | 0 | 0 | 76 | 76 | 629 |

Table 3 provides the HFRR data for additive concentrates containing the Inventive Additive (Example No. 3); the Inventive Additive with glycerol monooleate (GMO) (Example Nos. 6 and 7); and the Inventive Additive with fatty amine diethoxylate (Example Nos. 8 and 9). The HFRR data for an additive concentrate containing the Inventive Additive and both GMO and the fatty amine diethoxylate is shown in Example No. 11. Table 3 also provides the HFRR data for Comparative Example 4, GMO, and diethoxylated laurylamine. The Inventive Additive had a lower HFRR wear scar (575 microns) than either Comparative Example 4 (580), GMO (600) or diethoxylated lauryl amine (668) when tested at equal treat rate. It was surprising that the combination of the Inventive Additive and GMO gave a lower wear scar (566) than either component alone. The combination of the Inventive Additive with diethoxylated lauryl amine gave a lower wear scar (635) than diethoxylated laurylamine. In addition, when a small amount of the Inventive Additive was added to the additive concentrate containing both GMO and diethoxylated lauryl amine (Ex. No. 11) the resulting wear scar was better than GMO alone and the fatty aminediethoxylates alone.

In the following table friction tests were conducted on SAE 0W-20 passenger car engine oil containing all of the standard engine oil components, but without friction modifiers. The treat rate of the friction modifier additives was 0.25 wt. % in the lubricant. The friction tests were conducted using a high frequency reciprocating rig (HFRR) under a 4 N load with a stroke distance of 1 millimeter at 20 Hz and a temperature of 130° C. The friction results are provided in table 4.

TABLE 4

HFRR Coefficient of Frictions for Fuel Additive concentrates in engine oil

| Example No. | | Coefficient of Friction |
|---|---|---|
| 1 | Baseline Engine oil | 0.146 |
| 2 | Baseline oil with Comparative Example 1 | 0.120 |
| 3 | Baseline oil with Comparative Example 2 | 0.117 |
| 4 | Baseline oil with Comparative Example 3 | 0.134 |
| 5 | Baseline oil with Comparative Example 4 | 0.120 |
| 6 | Baseline oil with Inventive Additive | 0.118 |

Table 4 provides the HFRR friction for the Inventive and comparative additives (Ex. Nos. 2-6) in a formulated engine oil without friction modifiers. In this case, the Inventive Additive (Ex. No. 6) provided a significant reduction in friction compared to the baseline oil (Ex. No. 1). The Inventive Additive (Ex. No. 6) and the comparative fuel additives (Ex. Nos. 2-5) gave similar coefficients of friction and all were better than the comparative fuel additive 3 (Ex. No. 4).

An important characteristic of the fuel additives of the present disclosure is their stability in fuel additive concentrates at low temperatures. Accordingly, in order to provide sufficient additive to a fuel to improve the wear in the fuel delivery system as well as the increasing the fuel economy of an engine, the additive concentrate containing the foregoing inventive fuel additives must be stable and remain stable at low temperatures for an extended period. It would also be very advantageous if the fuel additives of the present disclosure could improve the stability of fuel additive concentrates containing fatty amine ethoxylates or partial esters of fatty acids or both at low temperatures. By "stable" and "stability" it is meant the additive concentrate remains a clear fluid that is substantially free of sediment or precipitate and completely free of suspended matter, flocculent, and phase separation at temperatures as low as about −20° C. over a period of time. Samples that are clear and bright (CB) or have a trace of sediment (light sediment) are considered to be acceptable.

In the following examples, the low temperature storage stability of gasoline fuel additive concentrates containing the Inventive Additive were compared to additive concentrates containing the additives of Comparative Examples 1-4. Table 5 also contains stability data on fuel additive concentrates containing GMO and diethoxylated lauryl amine.

Each of the additive concentrates in the following table contained 28.9 wt. % of a commonly used Mannich detergent, 19.9 wt. % of an aromatic solvent, 1.1 wt. % of a $C_8$ branched alcohol, carrier fluids, corrosion inhibitors, demulsifiers, and the like. The total treat rate of the components other than the inventive additives and additional solvent was 67.3 wt. %. Approximately 10 grams of each additive concentrate was placed in a glass vial and stored at −20° C. for 28 days. The vials were visually inspected after 14 and 28 days and rated. The results are shown in the table below. The amount of additive and additional solvent (95:5 wt. ratio of aromatic:$C_8$ branched alcohol) in each of the examples is given in the table below. All amounts are given in weight percent.

TABLE 5

Compatibility Data

| Ex. No. | Inventive Additive | Comp. Ex. 1 | Comp. Ex. 2 | Comp. Ex. 3 | Comp. Ex. 4 | GMO | Diethoxylated laurylamine | Solvent | |
|---|---|---|---|---|---|---|---|---|---|
| | | | | | | | | | Four weeks at −20 ° C. |
| 1 | 15 | 0 | 0 | 0 | 0 | 0 | 0 | 17.7 | CB |
| 2 | 0 | 10 | 0 | 0 | 0 | 0 | 0 | 22.7 | Heavy Sediment |
| 3 | 0 | 0 | 10 | 0 | 0 | 0 | 0 | 22.7 | Heavy Sediment |
| 4 | 0 | 0 | 0 | 15 | 0 | 0 | 0 | 17.7 | CB |
| 5 | 0 | 0 | 0 | 0 | 15 | 0 | 0 | 17.7 | Medium Sediment |
| 6 | 0 | 0 | 0 | 0 | 10 | 0 | 0 | 22.7 | Light Sediment |
| 7 | 0 | 0 | 0 | 0 | 0 | 5 | 0 | 27.7 | Medium Sediment |
| 8 | 5 | 0 | 0 | 0 | 0 | 5 | 0 | 22.7 | Light Sediment |
| 9 | 10 | 0 | 0 | 0 | 0 | 5 | 0 | 17.7 | CB |
| 10 | 0 | 10 | 0 | 0 | 0 | 5 | 0 | 17.7 | Heavy Sediment |
| 11 | 0 | 0 | 10 | 0 | 0 | 5 | 0 | 17.7 | Heavy Sediment |
| 12 | 0 | 0 | 0 | 10 | 0 | 5 | 0 | 17.7 | CB |
| 13 | 0 | 0 | 0 | 0 | 0 | 5 | 10 | 17.7 | CB |
| 14 | 0 | 0 | 0 | 0 | 0 | 0 | 10 | 22.7 | CB |
| 15 | 10 | 0 | 0 | 0 | 0 | 0 | 10 | 12.7 | CB |
| 16 | 0 | 10 | 0 | 0 | 0 | 0 | 10 | 12.7 | Heavy Sediment |
| 17 | 0 | 0 | 10 | 0 | 0 | 0 | 10 | 12.7 | Heavy Sediment |
| 18 | 0 | 0 | 0 | 10 | 0 | 0 | 10 | 12.7 | CB |
| 19 | 0 | 0 | 0 | 0 | 0 | 0 | 17.5 | 15.2 | Solid |
| 20 | 2.5 | 0 | 0 | 0 | 0 | 0 | 17.5 | 12.7 | Light Sediment |
| 21 | 0 | 0 | 0 | 2.5 | 0 | 0 | 17.5 | 12.7 | Solid |
| | | | | | | | | | Two weeks at −20 ° C. |
| 22 | 2.5 | 0 | 0 | 0 | 0 | 0 | 20 | 10.2 | CB |
| 23 | 0 | 0 | 0 | 2.5 | 0 | 0 | 20 | 10.2 | Heavy Sediment |
| 24 | 10 | 0 | 0 | 0 | 0 | 10 | 0 | 12.7 | CB |
| 25 | 0 | 0 | 0 | 10 | 0 | 10 | 0 | 12.7 | Medium Sediment |
| 26 | 0 | 0 | 0 | 0 | 10 | 10 | 0 | 12.7 | Medium Sediment |
| 27 | 0 | 0 | 0 | 0 | 0 | 10 | 0 | 22.7 | Medium Sediment |

As shown in Table 5, the fuel additive concentrates that contain the Inventive Additive (Ex. Nos. 1, 9, and 15) remained clear and bright (CB) after four weeks at a temperature of −20° C. whereas the additive concentrates containing Comparative Examples 1 and 2 (Ex. Nos. 2, 3, 10, 11, 16, and 17) had heavy sediment after four weeks at −20° C. Comparative Example 3, which is the fuel additive made from a branched fatty acid using the non-inventive process, provided stable fuel additive concentrates that remained liquid at low temperature (Ex. Nos. 4, 12, and 18). However, the fuel additive concentrates containing Comparative Example 3 and high levels of GMO or diethoxylated laurylamine became hazy within a week and unstable after two weeks (Ex. Nos. 21, 23 and 25). Thus, the Inventive Additive significantly improves the stability of fuel additive concentrates that would otherwise be unstable (Ex. Nos. 7, 19, and 27) and allows the fuel additives to be used in concentrates that are stable at −20° C. (Ex. Nos. 9, 20, and 24). Comparative Example 4 is a mixture of alkanolamides made from coconut oil and methyl caprylate using the method disclosed in U.S. Pat. No. 6,524,353 B2. The use of methyl caprylate in the reaction mixture improves the low temperature performance of fuel additive product when it is blended into concentrates at 50% with aromatic solvent. However, the fuel additive concentrates that were made from Comparative Example 4 (Ex. Nos. 5 and 26) were not stable at −20° C. when they were formulated with the fully formulated concentrates.

Accordingly, based on the foregoing stability tests, the fuel additive concentrates that are made with the Inventive Additive had satisfactory stability at low temperature and the Inventive Additive may be used to improve the low temperature storage stability of a fuel additive composition that contains a fatty amine ethoxylate or GMO or both.

In the following examples, the low temperature storage stability of gasoline fuel additive concentrates containing the Inventive Additive were compared to additive concentrates containing mixtures of N,N-bis(2-hydroxyethyl)alkylamides (I) also called Coco-DEA and the coconut fatty acid esters and amides derived from the self-condensation products of two diethanolamines; 2-((2-(bis(2-hydroxyethyl)amino)ethyl)amino)ethyl alkanoate and N-(2-(bis(2-hydroxyethyl)amino)ethyl)-N-(2-hydroxyethyl)alkyl-amide (also called Coco-dimer DEA). The Coco-DEA was made from coconut fatty acid and purified to remove any products derived from DEA dimers, trimers and higher oligomers. Likewise, the Coco-dimer DEA was made from coconut fatty acid and purified to remove any Coco-DEA and products derived from DEA trimers and higher oligomers. Each of the additive concentrates in the following table contained the same additive components as were used in Table 5. The treat rates of the Coco-DEA and Coco-dimer DEA mixtures as well as the treat rate of the inventive additive was 20% wt. Approximately 10 grams of each additive concentrate was placed in a glass vial and stored at −20° C. for 28 days. The vials were visually inspected after 7 and 28 days and rated. The results are shown in the table below.

TABLE 6

Relative Compatibility Data

| Coco-DEA (wt. %) | Coco-dimer DEA (wt. %) | 7 days at −20° C. | 28 days at −20° C. |
|---|---|---|---|
| 100 | 0 | Heavy Sediment | Solid |
| 95 | 5 | Heavy Sediment | Solid |
| 90 | 10 | Heavy Sediment | Heavy Sediment |
| 85 | 15 | Light Sediment | Heavy Sediment |
| 80 | 20 | CB | Light Sediment |
| 75 | 25 | CB | Light Sediment |
| Inventive additive | | CB | CB |

The data shows the beneficial effect that the Coco-dimer DEA has on the low temperature compatibility of the additive concentrates. Above 15% addition, the additive concentrate is clear and bright at day 7 whereas pure Coco-DEA is already showing heavy sediment (15% treat rate is showing light sediment). At 28 days, addition of Coco-dimer DEA at 25% shows light sediment where lower treat rate shows heavy sediment or even solidification at 0% and 5%. Only the inventive additive is still clear and bright at 28 days. In all case, the inventive additive performs better than the Coco-dimer DEA. Without wishing to be bound by theory it may be that although the inventive additive contains Coco-DEA, it also contains ester/amides of trimers and other oligomers of DEA that enhance the properties at cold temperature.

Additionally, the Inventive Additive was evaluated for effectiveness in reducing fuel consumption in gasoline engines. The tests were conducted using the US Federal Test Procedure FTP-75 on chassis dynamometers under controlled temperature and humidity conditions while using the transient phase ("Bag 2") driving schedule in triplicate.

TABLE 7

Chassis Dynamometer Testing: Fuel Economy Increase

| Inventive Additive (ppm by wt.) | | % Fuel Economy Increase |
|---|---|---|
| 0 | Gasoline plus no top treat additive | 0 |
| 228 | 2010 Ford F150 4.6L/V8 | 0.71 |
| 342 | 2015 Volkswagen Golf 1.8L/DI | 0.84 |

As shown in the foregoing table, the Inventive Additive in a fuel additive composition at 228 and 342 ppm provided significant fuel economy increases compared to the base fuel composition that was devoid of the Inventive Additive. Accordingly, in addition to friction and wear reduction and low temperature stability, the Inventive Additive also provides fuel economy improvements in gasoline fuels.

An engine test measuring fuel injector deposits (referred to as "DIG test") was performed following a procedure disclosed in *SAE Int. J. Fuels Lubr.* 10(3):2017 "A General Method for Fouling Injectors in Gasoline Direct Injection Vehicles and the Effects of Deposits on Vehicle Performance." A mathematical value of Long Term Fuel Trim (LTFT) was used to gauge the effectiveness of additives to clean up the injectors in a gasoline engine by running a dirty-up phase until the LTFT is 9-10% higher than at the start of test (approximately 6,000 miles) followed by a clean-up phase (approximately 2,000 miles). The lower the % LTFT at 8,000 miles, the more effective the additive is in cleaning up dirty injectors. For the DIG test, a 2012 Kia Optima (L-4, 2.4 L engine) equipped with a Direct Injection fuel management system was used. The inventive additive was used at 67 ppm in a formulation that did not contain detergent. The results are shown in the following table.

TABLE 8

DIG Test: Injector Deposit Clean-up

| Additive | Treat rate (ppm) | LTFT % after dirty-up | % Improvement after clean-up |
|---|---|---|---|
| Inventive | 67 | 9.2 | 98 |

The inventive example showed a significant clean-up of dirty injectors for a DIG engine at a relatively low treat rate.

The pour point data in table 1 shows that the inventive additive had a lower pour point than both comparative example 1 (3° C.) and comparative example 2 (−2° C.). The pour point of the inventive additive is −9° C. when fatty acids derived from coconut oil are used. When pure lauric acid is used to make the additive mixture described herein, a pour point of −15° C. is observed and the pour point goes down to −34° C. when using pure caprylic acid. It is well known to one skilled in the art that shorter fatty acid chains result in better cold flow properties. Coconut oil possesses some palmitic and stearic acid, which increases the pour point whereas caprylic acid ($C_8$) has a shorter hydrocarbon chain than lauric acid (C12). It was surprising and unexpected that the pour point of the inventive additive would be lower than the comparable examples 1 and 2 when all three additives use the same fatty acid to make the additive.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A fuel additive concentrate for gasoline comprising an aromatic solvent and a mixture comprising (i) N,N-bis(2-hydroxyethyl)alkylamide, (ii) 2-((2-(bis(2-hydroxyethyl) amino)ethyl)-amino)ethyl alkanoate and N-(2-(bis(2-hydroxyethyl)-amino)ethyl)-N-(2-hydroxyethyl)alkyl-amide, and (iii) fatty acid ester(s) and amide(s) derived from a self-condensation product of diethanolamine (DEA) containing at least 3 amino groups, wherein a weight ratio of (i) to (ii) to (iii) ranges from about 8:2:0 to about 2:5:3 and wherein the fuel additive mixture is substantially devoid of glycerin and remains fluid at a temperature down to about −20° C.

2. The fuel additive concentrate of claim 1, wherein the mixture comprises less than 3 wt. % N,N'-bis(2-hydroxyethyl)piperazine based on a total weight of the additive mixture.

3. The fuel additive concentrate of claim 1, wherein the mixture comprises less than 0.5 wt. % N,N'-bis(2-hydroxyethyl)piperazine based on a total weight of the additive mixture.

4. The fuel additive concentrate of claim 1, wherein the mixture comprises from about 5 to about 30 wt. % of fatty acid ester(s) and amide(s) derived from a self-condensation product of DEA containing at least 3 amino groups based on a total weight of the additive mixture.

5. The fuel additive concentrate of claim 1, wherein the alkyl groups of the amide(s) and ester(s) contain from 8 to 18 carbon atoms.

6. The fuel additive concentrate of claim 5, wherein about 45 wt. % to about 55 wt. % of the alkyl groups in the amide(s) and ester(s) are dodecyl groups.

7. The fuel additive concentrate of claim 1, further comprising one or more detergents and one or more carrier fluids.

8. The fuel additive concentrate of claim 1, further comprising a friction modifier selected from the group consisting of partial esters of fatty acid and polyhydroxy alcohols, N,N-bis(hydroxyalkyl)alkylamine, and mixtures thereof, wherein a weight ratio of the friction modifier to the mixture in the concentrate ranges from about 10:1 to about 1:10.

9. A gasoline fuel composition comprising from about 10 to about 1500 ppm by weight of the fuel additive concentrate of claim 1 based on a total weight of the fuel composition.

10. A gasoline fuel composition for reducing fuel system component wear and engine friction, and improving injector cleanliness, comprising:

A) gasoline and

B) a fuel additive mixture containing a) N,N-bis(2-hydroxyethyl)alkylamide, b) 2-((2-(bis(2-hydroxyethyl)amino)ethyl)amino)ethyl alkanoate and N-(2-(bis(2-hydroxyethyl)amino) ethyl)-N-(2-hydroxyethyl)alkylamide, and c) fatty acid ester(s) and amide(s) derived from a self-condensation product of diethanolamine (DEA) containing at least 3 amino groups, wherein the alkyl groups of the amide(s) and ester(s) contain from 8 to 18 carbon atoms and wherein a weight ratio of (a) to (b) to (c) in the fuel additive mixture ranges from about 8:2:0 to about 2:5:3 and wherein the fuel additive mixture is substantially devoid of glycerin and remains fluid at a temperature down to about −20 C°.

11. The gasoline fuel composition of claim 10, wherein the fuel additive mixture comprises less than 0.5 wt. % N,N'-bis(2-hydroxyethyl)piperazine based on a total weight of the additive mixture.

12. The gasoline fuel composition of claim 10, wherein the fuel additive mixture comprises from about 5 to about 30 wt. % of fatty acid ester(s) and amide(s) derived from a self-condensation product of DEA containing at least 3 amino groups based on a total weight of the additive mixture.

13. The gasoline fuel composition of claim 10, wherein the gasoline fuel composition comprises from about 10 to about 1500 ppm by weight of the fuel additive mixture based on a total weight of the fuel composition.

14. A method for reducing wear and engine friction, comprising:

providing gasoline containing a wear reducing additive mixture consisting essentially of:

a) N,N-bis(2-hydroxyethyl)alkylamide, b) 2-((2-(bis(2-hydroxyethyl)amino)ethyl)amino)ethyl alkanoate and N-(2-(bis(2-hydroxyethyl)amino) ethyl)-N-(2-hydroxyethyl)alkylamide, and c) fatty acid ester(s) and amide(s) derived from a self-condensation product of diethanolamine (DEA) containing at least 3 amino groups, wherein the additive mixture is substantially devoid of glycerin and a weight ratio of (a) to (b) to (c) ranges from about 8:2:0 to about 2:5:3;

combining the additive mixture with gasoline to provide a fuel composition; and operating the engine on the fuel composition.

15. The method of claim 14, wherein the gasoline contains from about 10 to about 1500 ppm by weight of a fuel additive concentrate comprising the additive mixture based on a total weight of the gasoline and fuel additive concentrate.

16. The method of claim 15, wherein the additive concentrate comprises from about 10 to about 90 wt. % of the additive mixture based on a total weight of the additive concentrate.

17. The method of claim 15, wherein the fuel additive concentrate remains fluid at a temperature down to about −20 C°.

18. The method of claim 14, wherein the amount of fatty acid ester(s) and amide(s) derived from a self-condensation product of DEA containing at least 3 amino groups in the additive mixture ranges from about 5 to about 30 wt. % of the total weight of the additive mixture.

19. The method of claim 18, wherein the alkyl groups of the amide(s) and ester(s) contain from 8 to 18 carbon atoms.

20. A method for improving the injector performance of a fuel injected gasoline engine, comprising:

providing gasoline containing an injector cleaning additive mixture consisting essentially of:

a) N,N-bis(2-hydroxyethyl)alkylamide, b) 2-((2-(bis(2-hydroxyethyl)amino)ethyl)amino)ethyl alkanoate and N-(2-(bis(2-hydroxyethyl)amino) ethyl)-N-(2-hydroxyethyl)alkylamide, and c) fatty acid ester(s) and amide(s) derived from a self-condensation product of diethanolamine (DEA) containing at least 3 amino groups, wherein the additive mixture is substantially devoid of glycerin and a weight ratio of (a) to (b) to (c) ranges from about 8:2:0 to about 2:5:3;

combining the additive mixture with gasoline to provide a fuel composition; and operating the engine on the fuel composition.

21. The method of claim 20, wherein the gasoline contains from about 10 to about 1500 ppm by weight of a fuel additive concentrate comprising the additive mixture based on a total weight of the gasoline and fuel additive concentrate.

22. The method of claim 21, wherein the additive concentrate comprises from about 10 to about 90 wt. % of the additive mixture based on a total weight of the additive concentrate.

23. The method of claim 21, wherein the fuel additive concentrate remains fluid at a temperature down to about −20 C°.

24. The method of claim 20, wherein the amount of fatty acid ester(s) and amide(s) derived from a self-condensation product of DEA containing at least 3 amino groups in the additive mixture ranges from about 5 to about 30 wt. % of the total weight of the additive mixture.

25. The method of claim 24, wherein the alkyl groups of the amide(s) and ester(s) contain from 8 to 18 carbon atoms.

* * * * *